US012629748B2

(12) United States Patent
Han

(10) Patent No.: US 12,629,748 B2
(45) Date of Patent: May 19, 2026

(54) METHOD FOR ENHANCING CREEP AGE FORMING PROCESS OF A METALLIC COMPONENT

(71) Applicant: Qingyou Han, West Lafayette, IN (US)

(72) Inventor: Qingyou Han, West Lafayette, IN (US)

( * ) Notice: Subject to any disclaimer, the term of this patent is extended or adjusted under 35 U.S.C. 154(b) by 359 days.

(21) Appl. No.: 18/100,556

(22) Filed: Jan. 23, 2023

(65) Prior Publication Data

US 2023/0158564 A1 May 25, 2023

Related U.S. Application Data

(62) Division of application No. 16/933,006, filed on Jul. 20, 2020, now Pat. No. 11,597,008.

(51) Int. Cl.

| | |
|---|---|
| ***B22D 27/08*** | (2006.01) |
| ***B21D 35/00*** | (2006.01) |
| ***B21J 5/00*** | (2006.01) |
| ***B22D 17/20*** | (2006.01) |

(52) U.S. Cl.

CPC ..... *B22D 27/08* (2013.01); *B21D 35/008* (2013.01); *B21J 5/006* (2013.01); *B22D 17/20* (2013.01)

(58) Field of Classification Search

CPC .... B22D 17/20; B22D 27/08; B22D 17/2069; B22D 17/32; B21D 35/008; B21J 5/006; G01N 11/00; G01N 13/04; G01N 15/082; G01N 2203/0256; G01N 3/08

See application file for complete search history.

(56) References Cited

FOREIGN PATENT DOCUMENTS

| | | | |
|---|---|---|---|
| RU | 2447162 | * | 4/2012 |
| UA | 46841 U | * | 1/2010 |

OTHER PUBLICATIONS

"Tension and Compression Testing" 2014. Handbook of analytical methods for materials. p. 45-46. (Year: 2014).*

Emmer, S. et al. "Materials for sonotrode tools." 2013. Scientific proceedings 2013, Faculty of mechanical engineering, STU in Bratislava. 21. p. 44-50. (Year: 2013).*

* cited by examiner

*Primary Examiner* — Nicholas A Wang

(57) ABSTRACT

A method for accelerating the creep age forming of a metallic component is provided. The method includes the steps of applying static loading and ultrasound vibrations to the local regions on a metallic component during the creep age forming process. The transmission of ultrasound in the component enhances the mobility of dislocations and atoms and thus accelerates the creep deformation in the component.

3 Claims, 4 Drawing Sheets

Prior Art -- Squeeze Pin at Back Position

Prior Art -- Squeeze Pin at Forward Position

Sonotrode at Back Position

Sonotrode at Forward Position

METHOD FOR ENHANCING CREEP AGE FORMING PROCESS OF A METALLIC COMPONENT

CROSS-REFERENCE OF RELATED APPLICATIONS

The present U.S. patent application is a divisional application of U.S. patent Ser. No. 16,933,006 filed Jul. 20, 2020. The contents of the prior application are hereby incorporated by reference in its entirety into the present disclosure.

FIELD OF THE INVENTION

The present invention relates to creep age forming process, more specifically, to accelerate local creeping deformation in a metallic component using a combined effect of loading, ultrasound, and heat on local regions of the component.

BACKGROUND OF THE INVENTION

Castings, especially those made using the high pressure die casting (HPDC) process, usually contain a certain percentage of defects such as porosity [1], oxides, and sometimes hot hear [2]. The existence of defects leads to poor mechanical properties, pressure-tightness, and leak-tightness of the castings [2]. When the defect is larger than a certain size, usually a few millimeters, in critical locations of a casting where high mechanical properties or high leak-tightness are required, the casting has to be rejected as a scrap.

There are two types of defects which are classified by their location in a casting: internal defects and external defects. External defects occur on the surfaces or the machined surfaces of a casting and can be repaired using welding such as laser welding and arc welding. Internal defects are difficult to repair. They exist more in heavy sections than in thin walled sections in a casting. To make things worse, the solidification structure in the heavy sections is usually coarser than in the thin-walled section. Most casting alloys contain eutectic and intermetallic phases that are brittle [3]. Large dendrites of the primary solid phase also make the distribution of the brittle phases unfavorable. The combination of the coarse microstructure and defects makes the mechanical properties low and property reliability of a casting poor. From that sense, the coarse microstructure is also considered as a kind of internal defect. In die casting, external large dendrites are found in thick section of a casting [4]. Friction stir welding is capable of removing internal defects including the coarse microstructure but has not been widely used.

Effort has been focused on preventing certain internal defects from forming during the solidification process of a casting. For example, shrinkage porosity is an internal defect and is usually formed in the heavy sections of a casting where liquid feeding from a riser or a biscuit is difficult [1-2]. Squeeze pins are usually used to reduce porosity in the middle of heavy sections or "hot spots". The squeeze pin pushes a certain amount of solidifying metal back into the interior of a hot spot [5-6], feeding the solidification shrinkage there and, in the meantime, building up pressure that is beneficial in reducing the size of a pore if not eliminating it in the hot spot [1]. However, there are a number of issues associated with the use of a squeeze pin.

Firstly, the use of a squeeze pin brings in large oxide films into the interior of a casting. The surfaces of a casting are usually covered by a layer of oxide. When an extra amount of solidifying metal is pushed back into the interior of a local hot spot in a casting, the surface oxide layer is also pushed into the interior of the casting. This layer of oxide becomes an entrapped oxide film within a casting. There is a need to break up the large oxide films into smaller fragments.

Secondly, segregation bands and cracks are formed when the solidifying surface skin of a casting is torn apart by the squeeze pin, leaving behind cracks and segregation bands. Cracks that form when the fraction solid is small are filled by the solute-rich residual liquid in the mushy zone, forming segregation bands. Cracks that form in the mushy zone of large fraction solid cannot be filled by the liquid and remain as cracks in the casting. Thus, the use of the squeeze pin reduces porosity in the hot spot but introduces other defects in the casting. Unfortunately, internal defects such as oxide films and cracks cannot be eliminated, leading to poor mechanical properties and reliability of the casting. There is a need to close out or heal the internal cracks as well.

Therefore, there is a need for developing a novel technology that is capable of reducing or even eliminating internal defects such as shrinkage pores and cracks, breaking up oxide films, and refining the solidification microstructure in the hot spot in a casting during its solidification process while the casting is still in its casting molds.

There is also a need for developing technologies that can be used to repair a casting with internal defects detected after the casting has been made.

Creep age forming of a metallic component is a technique by which a component is placed on a former and heated to predetermined temperatures while the component, under loadings, slowly takes up the form of the former.

As pointed out by Levers (U.S. Pat. No. 7,322,223), the technique can be uneconomic because of 1) forming can take a long time because creep deformation is a slow process, 2) the tooling can be complex in shape to allow the correct profile to be formed, and 3) factors such as spring-back must be taken into account and factors.

It is an objective of this invention to provide an improved method of creep age forming metallic components.

SUMMARY OF THE INVENTION

In an exemplary embodiment of the present invention, a process of reducing or eliminating internal defects in local critical regions in a casting is provided. The process includes the steps of preparing a plurality of ultrasound-assisted squeeze pins in casting molds with cavities for hosting an additional amount of molten metal attached to a casting, filling mold cavity with a liquid metal, exciting each ultrasound-assisted pin during the solidification of the liquid metal adjacent to the pin, and pushing a portion of the cast material back into the interior of the casting using each ultrasound-excited pin after an isolated melt pool is formed near the pin within the dwell time of the casting in the casting molds. Such a process uses the combined effect of compression, ultrasound, heat, and feeding using extra material on improving the solidification microstructure, producing a non-dendritic or globular primary solid phase, and discrete eutectic phases, intermetallic phases and oxide films in critical locations in a casting.

In another exemplary embodiment of the present invention, a process is provided for reducing or eliminating defects in critical regions in a casting. The process includes the steps of preparing a plurality of ultrasound-assisted squeeze pins in casting molds with cavities for hosting an additional amount of molten metal attached to a casting, filling mold cavity with a liquid metal, exciting each ultrasound-assisted pin during the solidification of the liquid metal adjacent to the pin, and pushing a portion of cast material back into the interior of the casting using each ultrasound excited pin after an isolated melt pool is formed near the pin with the dwell time of the casting in the casting molds. Such a process uses the combined effect of compression, ultrasound, heat, and feeding using extra material on improving the internal integrity of the solidifying material by feeding the solidification shrinkage, breaking up oxide films, and healing cracks in critical locations in a casting.

In yet another exemplary embodiment of the present invention, a process is provided for enhancing mechanical properties in critical regions in a casting. The process includes the steps of preparing a plurality of ultrasound-assisted squeeze pins in casting molds with cavities for hosting an additional amount of molten metal attached to a casting, filling mold cavity with a liquid metal, exciting each ultrasound-assisted pin during the solidification of the liquid metal adjacent to the pin, and pushing a portion of cast material back into the interior of the casting using each ultrasound excited pin after an isolated melt pool is formed near the pin with the dwell time of the casting in the casting molds. Such a process uses the combined effect of compression, ultrasound, heat, and feeding using extra material on reducing defects and on producing a fine solidification microstructure which is beneficial for improving mechanical properties, especially ductility and fatigue resistant in critical locations of a casting.

In still another exemplary embodiment of the present invention, a process is provided for repairing defects in a solid casting. The process includes the steps of preparing the local defective regions of a solid casting at desired temperatures, preparing a plurality of ultrasound-assisted squeeze pins and anvils/ultrasound reflectors, placing an ultrasound-assisted squeeze pin at one side and an anvil/reflector at the other side of each defective region, and applying ultrasound vibration on the squeeze pins and compression loads on the defective regions in a casting for a predetermined duration of time. Such a process uses the combined effect of compression, ultrasound, and heat on consolidating defective regions in casting.

In still another exemplary embodiment of the present invention, a process is provided for enhancing creep age forming of a solid component. The process includes the steps of preparing local regions of the solid component at desired temperatures, preparing a plurality of ultrasound-assisted loading tools and forming dies as ultrasound reflectors, placing an ultrasound-assisted loading tool at one side and a die at the other side of each region in a component, and applying ultrasound vibration on the loading tools and compression loadings on local regions in the component for predetermined duration of time. Such a process uses the combined effect of compressive loading, ultrasound, and heat on enhancing creep age forming of local regions in a component that require large curvatures or complex geometry.

DETAILED DESCRIPTION OF THE INVENTION

Unless otherwise defined, all technical and scientific terms used herein have the same meaning as commonly understood by one of ordinary skill in the art to which this invention belongs. All publications, patent applications, patents, and other references mentioned herein are incorporated by reference in their entirety.

Shrinkage porosity occurs in the hot spots in a casting if the local liquid shrinkage cannot be fed [1]. In die casting or permanent mold casting industry, squeeze pins are used for eliminating or reducing porosity in hot spots [5-6].

Figure 1:
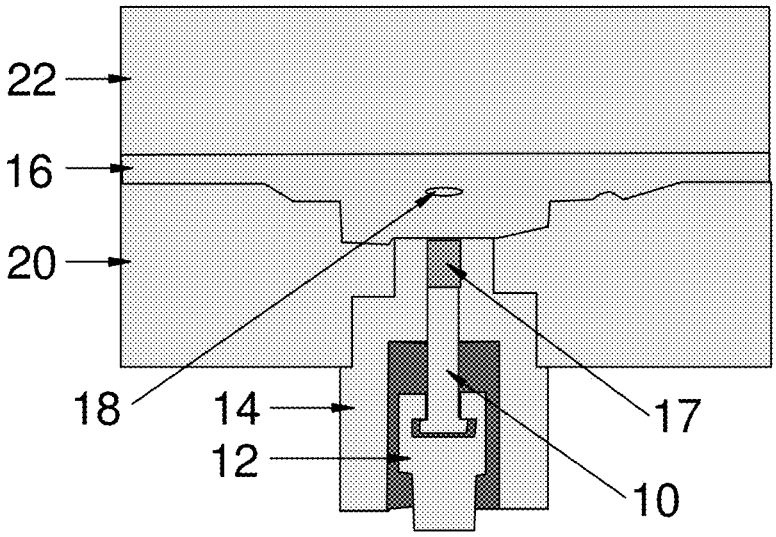
FIG. 1 is a side view of a layout of a prior art.
Figure 1:
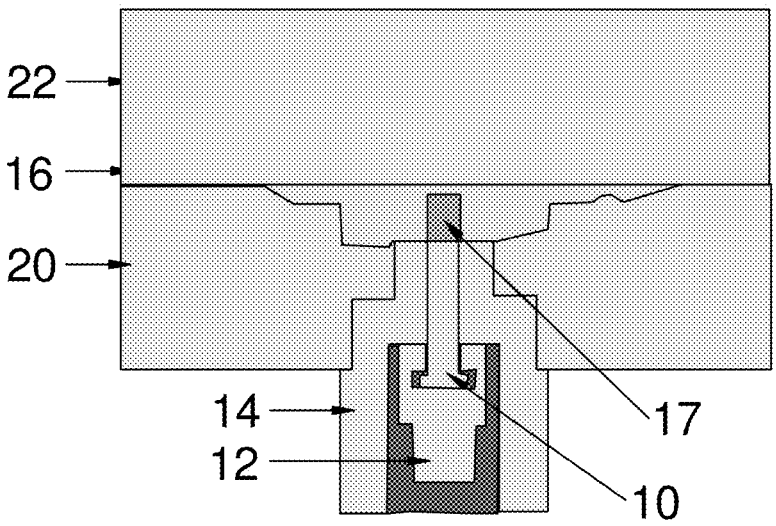

The prior arts using a squeeze pin is illustrated in FIG. 1. A portion of a casting 16 is shown in the cavity defined by molds 20 and 22. The thickness of the casting 16 at both sides is much smaller than that in the middle. On cooling, the thin-walled sections of the casting 16 solidify first with the liquid in the thicker section feeding the solidification shrinkage of the thinner sections. However, when the thicker section solidifies, no liquid is available to feed its solidification and a shrinkage pore 18 tends to form in the middle of the thicker section, which is the hot spot in casting 16. To eliminate the shrinkage pore 18, a squeeze pin 10 is used. The squeeze pin 10 is hosted in a housing 14 and is driven by a piston 12. Initially the squeeze pin 10 is at its back position. At the front of the squeeze pin 10, a cylindrical space is created in the housing 14 to host an extra amount of metal 17 to the casting 16. During mold filling, the squeeze pin 10 is at its back position. Liquid metal fills the space of the casting 16 and the slug 17. After the thin-walled portion of casting 16 is almost solidified, the squeeze pin 10 is fired to quickly reach its forward position, pushing the solidifying metal slug 17 into the interior of the casting 16. This metal slug 17 is used to feed the solidification shrinkage and to build up pressure in the hot spot. As a result, shrinkage pore 18 is eliminated because the local solidification shrinkage is fed and local high pressure prevents pores 18 from forming. However, there are a few problems associated with the use of such a squeeze pin 10. Oxide films that form on the surfaces of the slug 17 are pushed into the interior of the casting 16 as well, becoming internal oxide films. Also, as the slug 17 is pushed into the solidifying casting 16, dendrite networks in the slug 17 are crushed, which may produce cracks, and dendrites that are formed in the skin of the casting 16 adjacent to slug 17 are tore apart, which may also induce cracks. Consequently, the elimination of shrinkage pore 18 using a squeeze pin 10 leads to the formation of oxides and cracks in the interior of the casting 16. To avoid crack formation, the squeeze pin 10 has to be fired during the early stage of solidification in the hot spot when the fraction of solid in both the hot spot and the slug 17 is still small, which may push liquid from the hot spot back to the thin sections of the casting 16.

The present invention teaches to use the combined effect of compression, ultrasound, heat, and feeding using extra material on the solidifying material not only to eliminate porosity but also to refine the solidification structure, heal cracks, break up oxide films, and enhance the mechanical properties of the materials in the hot spot of a casting. The invention is made based on the following phenomena:

Ultrasonic grain refining: Applying high-intensity ultrasonic vibration to a solidifying material is capable of significantly modifying the morphology and reducing the grain size of the primary solid phase precipitating from the liquid in ultra pure metals [7] and their alloys [8]. The morphology of the eutectic phases is also modified, and their grain sizes are reduced [9-10]. U.S. Pat. No. 7,216,690 to Han et al. discloses the use of high-intensity ultrasonic vibration in a metal mold for achieving globular grains (from dendritic grains) suitable for semi-solid processing of metallic alloys. Such results, especially the formation of globular grains in the slug 17 and in the hot spot in the casting 16, should be achievable if a sonotrode is used to replace the squeeze pin 10 shown in FIG. 1 for die casting or permanent mold casting.

Shear thinning of semi-solid materials: A slurry containing up to 0.6 fractions of non-dendritic or globular primary solid phase grains experiences shear thinning, i.e. the viscosity of such a material decreases under shearing [11]. Such a semisolid material is capable of flowing under shear without forming cracks. A mushy material containing fractions of dendritic solid higher than that corresponding to the dendritic coherence points cracks during shearing. Under a compressive load by upsetting a test piece containing high fractions of solid, in the range of 0.6 to 0.99, the maximum upsetting stress for samples with non-dendritic grains is significantly (30 to 60%) lower than that of samples with dendritic grains [12]. Non-dendritic or globular grains slip over one another, exhibiting low resistance to deformation and high resistance to cracking. Dendritic grains interlock with each other, exhibiting high resistance to deformation and brittleness at high fractions of solid under strains and stresses [13-18]. Thus using a sonotrode to replace the squeeze pin 10 shown in FIG. 1 is capable of pushing semi-solid material containing high fractions of solid without causing crack formation because of the formation of globular solid grains in the slug 17 and in the hot spot in the casting 16.

Ultrasonic softening: Ultrasonic softening occurs in materials under combined static and cyclic loading. Ultrasound with a stress amplitude exceeding elastic strength brings about 40% or greater reduction in the static stress. Once the irradiation is ceased, the static stress returns to its original value [19]. Ultrasound is capable of driving dislocations to move, which is closely related to the plastic deformation of materials under loading. Furthermore, the materials under ultrasound irradiation are much higher in plasticity and resistance to cracking than that without subject to ultrasonic irradiation.

Ultrasonic welding: Ultrasound passing through the interface between two solid phases gives rise to certain phenomena at the interface and near it. In particular, the excitation of vibrations in one phase leads to its heating and plastic deformation. When an interface is subjected to a combined effect of ultrasound and some other factors such as static pressure, heating, and external forces, the interfacial phenomena are strongly intensified so that materials can be welded [20]. Thus, using the combined effect of compression, ultrasound, heat and feeding using extra material is capable of eliminating cracks and pores due to ultrasonic welding.

Figure 2:
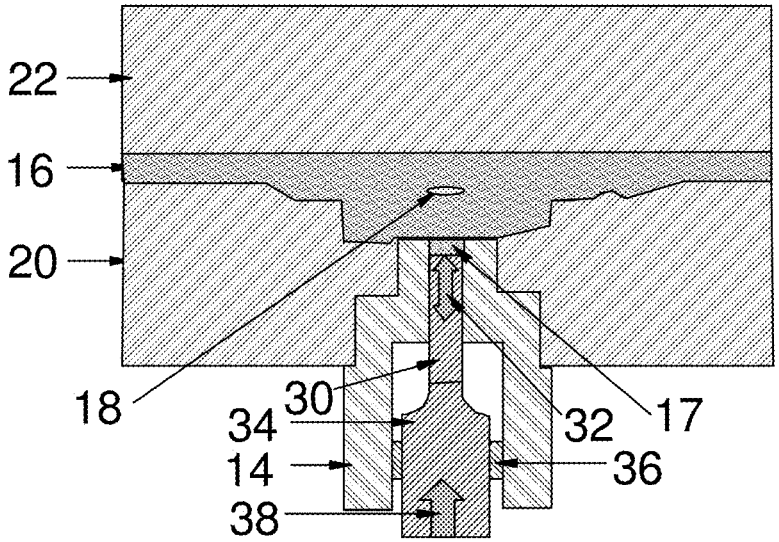
FIG. 2 is a side view of a layout of one embodiment of the present invention.
Figure 2:
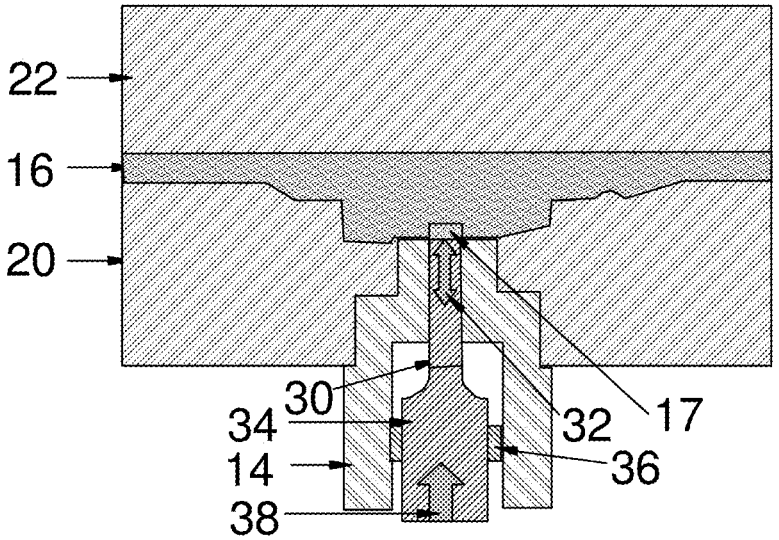

FIG. 2 illustrates a method and an apparatus according to one embodiment of the present invention. To eliminate the shrinkage pore 18 in the hot shot of the casting 16 in molds 20 and 22, a sonotrode 30 is used to replace the squeeze pin 10 shown in FIG. 1. The sonotrode 30 is hosted in a housing 14. Initially, the sonotrode 30 is at its back position. At the front of the sonotrode 30, a cylindrical space is created in the housing 14 to host an extra amount of metal 17 to the casting 16. The sonotrode 30 is tightly connected to the ultrasonic horn 34 and vibrates in the direction shown as the double headed arrow 32. The ultrasonic horn 34 is fixed at its nodal point on a structure 36. A compressive load 38 is applied at predetermined times on the horn 34 so that the compressive load is transmitted to the slug 17 through the sonotrode 30. During mold filling when the molten metal fills the cavity defined by the internal surfaces of the molds 20 and 22 and the tip of the sonotrode 30, the sonotrode 30 is at back position shown on the top drawing in FIG. 2. Ultrasonic vibration is irradiated to the molten metal in the hot spot through the sonotrode 30 to produce small and non-dendritic grains, small and modified eutectic phases, and broken intermetallic phases in the slug 17 as well as in the hot spot in casting 16. After the thin sections of the casting 16 adjacent to the hot spot have enough solid phases and an isolated liquid pool is formed within the hot spot, the compressive load 38 and ultrasonic vibrations are turned on to push the slug 17 into the casting 16 gradually. The material in slug 17 feeds the solidification shrinkage in the hot spot. Such an ultrasound-assisted compression tends to achieve a few beneficial effects including 1) healing cracks and voids, 2) feeding solidification shrinkage in the hot spot, and 3) breaking up oxide films and elongated brittle intermetallic phases that may exist in the hot spot by acoustic assisted deformation. The entire process of the combined effect of ultrasound and compression should be long enough to achieve maximum modification to the microstructure and the resultant mechanical properties but short enough so that the process is completed within the dwell time of the casting 16 in the molds 20 and 22. The times for ultrasonic irradiation and for compression can be optimized based on the material be processed. The hot spot thus processed by the combined effect of ultrasound and compression should contain fine microstructure, minimum defects, and superior mechanical properties compared to that processed using a conventional squeeze pin shown in FIG. 1.

Figure 3:
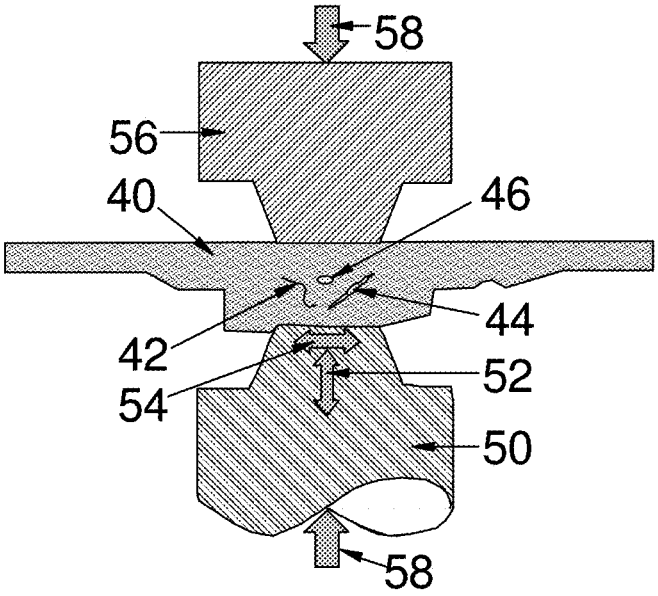
FIG. 3 is a side view of a layout of another embodiment of the present invention.

The present invention can also be used for reducing defects in a solid article that contains internal defects such as cracks, porosity, and oxide films. FIG. 3 illustrates a method and an apparatus of another embodiment of the present invention. A sonotrode 50 and an anvil or an ultrasound reflector 56 are used to apply a compressive load 58 on the critical location of a casting 40. The vibration of the sonotrode can be either in the direction 52 parallel to the compressive load 58 or in the direction 54 perpendicular to the compressive load 58. The casting 40 contains at least porosity 46, cracks 44, or oxide films 42 at certain locations. These defects are usually small in the size range of within a few millimeters. Porosity 40 and cracks 44 can be detected using non-destructive test (NDT) methods such as x-ray and CT-scan. Experienced engineers also know where these defects exist in a casting 40. By applying a compressive load 58 on a sonotrode 50 and an anvil or a reflector 56 to compress the casting 40 at elevated temperatures in a temperature window close to the solidus temperature of the solid material, the combined effect of compression, ultrasound, heat, and feeding using extra material on consolidating materials can be used for eliminating or at least reducing defects. A casting 40 just ejected from the die casting dies is usually at temperatures slightly below the solidus temperature of the material. At such a high temperature, internal cracks and pores tend be healed and the oxide films can be broken into fragments by the combined action of ultrasound, heat, and compressive load. A casting 40 at room temperature can also be heated up to a desired temperature by using conventional means of heating so that the present invention can be used to eliminate shrinkage porosity 46 and cracks 44. If the casting cannot be heated to temperatures high enough, the present invention using the combined effect of compression, ultrasound, heat and feeding using extra material can also be used at temperatures where the material of the casting creeps. As such a temperature range, the duration of the treatment has to be extended since creep is a slow process. However, creep is expected to accelerate under the influence of high-intensity ultrasonic vibration. By holding the defective region of a casting under compression for an extended amount of time at an elevated temperature, the creep deformation process can be used for filling the shrinkage porosity and cracks. The cracks and pores can also be closed under the combined effect of compression and ultrasound due to diffusion bonding.

The present invention shown in FIG. 3 can be extended for creep age forming (CAF) of metallic components. Creep forming of a metallic component by which a component such as an aluminum alloy plate is laid on a former/die and heated while the plate slowly takes up the form of the former is well known. U.S. Pat. No. 5,729,462 to Newkirk et al. first discloses the CAF process. This process has been used to manufacture extra-large panels in the aerospace industry [21]. However, this technique suffers from the disadvantage that forming can take a long time and that tooling is costly because it can be large and complex in shape to allow the correct profile to be formed. U.S. Pat. No. 7,322,223 to Levers et al. discloses a technique using a static load and a cycling load in the form of vibration up to a frequency of 1,000 Hz to reduce the forming time. U.S. patent application Ser. No. 15/551,946 discloses a die mechanism comprising a plurality of pin modules to replace the costly formers/dies used in the CAF process. The present invention shown in FIG. 3 is more effective in accelerating CAF than the aforementioned patents.

Figure 4:
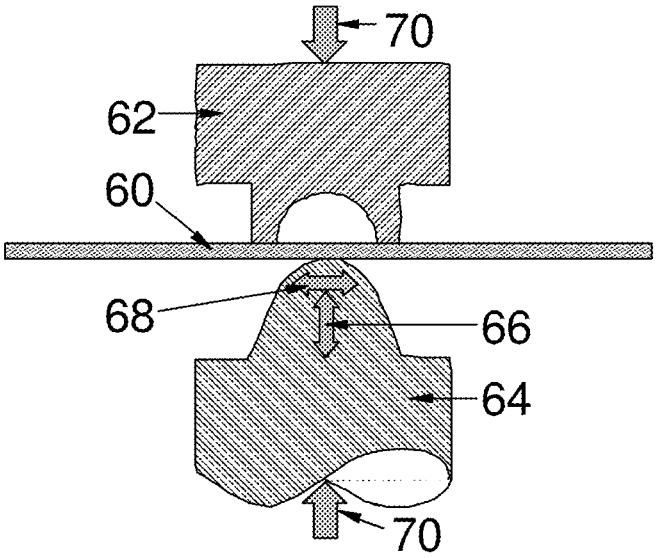
FIG. 4 is a side view of a layout of yet another embodiment of the present invention.

FIG. 4 illustrates a method and an apparatus of yet another embodiment of the present invention of ultrasound-assisted creep age forming. This invention can be used for creep age forming at local regions where large curvatures are required. As shown in FIG. 4, a forming die 70 and a sonotrode 64 are placed on the opposite sides of a component 60 held at a desired elevated temperature. The sonotrode 64 vibrates either in the direction 66 parallel with the applied load 70 or in the direction 68 perpendicular to the applied compressive load 70. The combined effect of ultrasound, compressive load, and heat deforms the component 60 to fill the cavity of the die 62 and to affect the profile of a large panel being CAF processed. A plurality of a sonotrode/die pair can be used for CAF of a large component to achieve its desired profile.

While the invention has been described in connection with specific embodiments thereof, it will be understood that the inventive methodology is capable of further modifications. This patent application is intended to cover any variations, uses, or adaptations of the invention following, in general, the principles of the invention and including such departures from the present disclosure as come within known or customary practice within the art to which the invention pertains and as may be applied to the essential features herein before set forth and as follows in scope of the appended claims.

REFERENCES

1. Q. Han, "Shrinkage Porosity and Gas Porosity," *ASM Handbook, vol.* 15, 2008, pp. 370-374.
2. J. Campbell, *Castings*, Butterworth & Heinemann, Oxford, 2000.
3. Q. Han, and S. Viswanathan, "The Use of Thermodynamic Simulation for the Hypoeutectic Aluminum-Silicon Alloys for Semi-Solid Metal Processing," *Materials Science and Engineering A, vol.* 364, 2004, pp. 48-54.
4. Q. Han, and J. Zhang, "Fluidity of Alloys Under High-Pressure Die Casting Conditions: Flow-Choking Mechanisms," *Metallurgical and Materials Transaction B, vol.* 51, 2020, to be published.
5. M. R. Ghomashchi, and A. Vikhrov, "Squeeze Casting: An Overview," *Journal of Materials Processing Technology, vol.* 101, 2000, pp. 1-9.
6. A. Sakhuja, and J. R. Brevick, "Finite Element Analysis of Laser Engineered Net Shape (LENS™) Tungsten Clad Squeeze Pins," *AIP Conference Proceedings*, vol. 712, 2004, pp. 1447-1452.
7. L. Han, C. Vian, J. Song, Z. Liu, Q. Han, C. Xu, and L. Shao, "Grain Refining of Pure Aluminum," *Light Metals,* 2012, pp. 967-971.
8. X. Jian, H. Xu, T. T. Meek, and Q. Han, "Effect of Power Ultrasound on Solidification of Aluminum A356 Alloy," *Materials Letters*, vol. 59, 2005, pp. 190-193.
9. X. Jian, T. T. Meek, and Q. Han, "Refinement of Eutectic Silicon Phase of Aluminum A356 Alloy Using High-Intensity Ultrasonic Vibration," *Scripta Materialia*, vol. 54, 2006, pp. 893-896.
10. Q. Han, "Ultrasonic Processing of Materials," *Metallurgical and Materials Transactions B, vol.* 46, 2015, pp. 1603-1614.
11. M. C. Flemings, "Behavior of Metal Alloys in the Semisolid State," *Metallurgical Transaction B*, vol. 22B, 1991, pp. 269-293.
12. G. I Eskin, *Ultrasonic Treatment of Light Alloy Melts*, Gorden and Breach, 1998.
13. Q. Han, M. I. Hassan, S. Viswanathan, K. Saito, and S. K. Das, "The Reheating-Cooling Method: A Technique for Measuring Mechanical Properties in the Nonequilibrium Mushy Zones of Alloys," *Metallurgical and Materials Transactions* A, vol. 36, 2005, 2073-2080.
14. M. G. Chu, and D. A. Granger, "The Tensile Strength and Fracture Behavior of partially Solidified Aluminum Alloys," *Materials Science Forum*, vols. 217-222, 1996, pp. 1505-1510.
15. T. Sumitomo, D. H. StJohn, and T. Steinberg, "The Shear Behavior of Partially Solidified Al—Si—Cu Alloys," *Materials Science and Engineering A*, vol. 289, 2000, pp. 18-29.
16. D. Levasseur, and D. Larouche, "Tensile Creep Testing of an Al—Cu Alloy Above Solidus with a Dynamic Mechanical Analyser," *Materials Science and Engineering* A, vol. 528, 2011, pp. 4413-4421.
17. Q. Bai, H. Li, Q. Du, J. Zhang, and L. Zhuang, "Mechanical Properties and Constitutive Behaviors of As-cast 7050 Aluminum Alloy from Room Temperature to Above the Solidus Temperature," *International Journal of Minerals, Metallurgy and Materials*, vol. 23, 2016, pp. 949-958.
18. H. Iwasaki, T. Mori, M. Mabuchi, and K. Higashi, "Shear Deformation Behavior of Al-5% Mg in a Semi-Solid State," *Acta Materialia*, vol. 46, 1998, pp. 6351-6360.
19. O. V. Abramov, *High-Intensity Ultrasonics: Theory and Industrial Applications*, Gorden and Breach, 1998.
20. J. Tsujino, "Recent Development of Ultrasonic Welding," 1995 IEEE Ultrasonics Symposium. Proceedings. An International Symposium, Seattle, WA USA. Vol. 2, 1995, pp. 1051-1060.

21. L. Zhan, J. Lin, and T. A. Dean, "A review of the Development of Creep Age Forming: Experimentation, Modeling and Applications," *Journal of Machine Tools and Manufacturing*, vol. 51, 2011, pp. 1-7.

What is claimed is:

1. A method for accelerating creep age forming process for making a final component having curved geometry from a flat sheet metal, the method comprising the steps of:

preparing at least one elongated sonotrode, the sonotrode comprising a first end and a second end, the first end connected to an ultrasound system and the second end comprising a tip;

providing a least one former having a curved surface;

preparing a loading device to each sonotrode;

placing the flat sheet metal on said at least one former;

placing each sonotrode to each location where accelerated creep deformation is required, with the sonotrode at one side and the former at the opposite side of the flat sheet metal at that location;

brining the flat sheet metal to predetermined temperatures; and applying loading to cause creep deformation in the component and applying ultrasonic vibrations through the sonotrode to the flat sheet metal at predetermined rates and times to accelerate local creep deformation until the flat sheet metal reaches its desired profile.

2. The method of claim 1, wherein the ultrasound system generates vibrations at the tip of the sonotrode at a frequency greater than 15,000 Hz.

3. The method of claim 1, wherein the sonotrode is made of a metallic alloy.

* * * * *